US007201254B2

(12) United States Patent
Redmann et al.

(10) Patent No.: US 7,201,254 B2
(45) Date of Patent: Apr. 10, 2007

(54) MACHINE HOUSING COMPONENT WITH ACOUSTIC MEDIA GRILLE AND METHOD OF ATTENUATING MACHINE NOISE

(75) Inventors: Michael A. Redmann, East Peoria, IL (US); Peter M. Zuehls, Peoria, IL (US); Jim K. Carroll, Peoria, IL (US); Ping Zhang, Peoria, IL (US); Peyman Agahi, Nottingham (GB)

(73) Assignee: Caterpillar Inc, Peoria, IL (US)

( * ) Notice: Subject to any disclaimer, the term of this patent is extended or adjusted under 35 U.S.C. 154(b) by 87 days.

(21) Appl. No.: 11/051,810

(22) Filed: Feb. 4, 2005

(65) Prior Publication Data

US 2006/0174708 A1 Aug. 10, 2006

(51) Int. Cl.
*F01N 1/24* (2006.01)

(52) U.S. Cl. ..... 181/204

(58) Field of Classification Search ..... 181/204
See application file for complete search history.

(56) References Cited

U.S. PATENT DOCUMENTS

| | | | | |
|---|---|---|---|---|
| 3,762,489 | A | 10/1973 | Proksch et al. | |
| 3,897,850 | A * | 8/1975 | Thompson et al. | 181/204 |
| 4,483,412 | A * | 11/1984 | Couturier | 181/204 |
| 4,993,381 | A | 2/1991 | Absenger | |
| 5,625,172 | A | 4/1997 | Blichmann et al. | |
| 6,273,213 | B1 * | 8/2001 | Callas et al. | 181/200 |
| 6,554,101 | B2 | 4/2003 | Watanabe et al. | |
| 6,595,013 | B1 | 7/2003 | Simeone | |
| 6,601,673 | B2 * | 8/2003 | Murakami et al. | 181/293 |
| 6,688,424 | B1 * | 2/2004 | Nakada et al. | 181/224 |
| 6,827,180 | B2 | 12/2004 | Wilson | |
| 2004/0146395 | A1 * | 7/2004 | Uselton | 415/119 |

FOREIGN PATENT DOCUMENTS

JP 04126928 A * 4/1992

* cited by examiner

*Primary Examiner*—Hezron Williams
*Assistant Examiner*—Rose M. Miller
(74) *Attorney, Agent, or Firm*—Liell & McNeil

(57) ABSTRACT

Air flow openings in a machine housing facilitate air exchange with a machine, but may become outlets for machine noise. In order to protect a machine from possibly damaging elements while facilitating air exchange and attenuating machine noise, the present disclosure includes a machine that is, at least, partially surrounded by a machine housing. An acoustic media grille is positioned adjacent to at least a portion of the machine housing. The acoustic media grille and the portion of the machine housing both define air flow openings that, at least partially, correspond with one another to form an at least partially unobstructed air flow path.

23 Claims, 6 Drawing Sheets

$$P = \frac{\pi}{2\sqrt{3}} \frac{D^2}{S^2}$$

$$t_{\min} = S - D = D\left(\sqrt{\frac{\pi}{2\sqrt{3_P}}} - 1\right) \approx D\left(\frac{.9523}{\sqrt{P}} - 1\right)$$

MACHINE HOUSING COMPONENT WITH ACOUSTIC MEDIA GRILLE AND METHOD OF ATTENUATING MACHINE NOISE

TECHNICAL FIELD

The present disclosure relates generally to noise producing machines, and more specifically to attenuating noise passing through a machine housing component.

BACKGROUND

Many machines, such as fans and engines, produce noise during operation. Perforated enclosures used to protect the machine and facilitate air flow to and from the machine can increase the noise. For instance, in order to protect an engine from damaging elements, such as debris and sand, the engine generally is surrounded by an engine housing. The engine housing includes perforations, herein referred to as air flow openings, that allow air flow to and from the engine. Often, the air flow openings are included within at least one detachable sheet metal panel attached to the engine housing. Although the air flow openings are necessary to the operation of the engine, the openings within the panel have become outlets for engine noise.

Over the years, various methods of reducing engine noise through the air flow openings of engine housings have been developed. For instance, a silencer with multiple acoustic louvers may be positioned between the engine and the housing panel. Some of the sound created by the engine and exiting through the air flow openings of the panel will be absorbed by the acoustic louvers. Although the acoustic louvers help attenuate engine noise, the approach is relatively costly being that the silencer includes multiple parts, including frames, retaining screens and louver panes. Moreover, a separate grille, needed to protect the louvers from damaging elements, often overlaps with the louvers, restricting air flow to and from the engine. In addition, the acoustic louver silencer generally cannot fit within small and/or irregular shaped spaces, and thus, may not be suitable for some engines.

Another approach is to position a baffle made, in part, from acoustic media between the engine and the housing panel. Although the acoustic baffle can absorb some of the sound created by the engine, air flowing to and from the engine must flow around the baffle. Although the acoustic baffle may attenuate engine noise, the acoustic baffle unduly restricts the air flow.

The present disclosure is directed at overcoming one or more of the problems set forth above.

SUMMARY OF THE INVENTION

According to one aspect of the present disclosure, a machine assembly includes a machine housing that, at least, partially surrounds a machine operated to produce noise, and includes at least one portion defining air flow openings. At least one acoustic media grille also defining air flow openings is positioned between the machine and the at least one portion of the machine housing. The air flow openings of the acoustic media grille, at least partially, correspond with the air flow openings of the portion of the machine housing to form an at least partially unobstructed air flow path.

According to another aspect of the present disclosure, a machine housing component includes a panel that is comprised of a relatively non-sound absorbent material to which an acoustic media grille including a relatively sound absorbent media is attached. The panel and the acoustic media, both, define air flow openings that at least partially correspond to one another to form an at least partially unobstructed air flow path.

According to yet another aspect of the present disclosure, machine noise is attenuated by, at least partially, surrounding a machine with a machine housing, and positioning an acoustic media between the machine and the machine housing. Air exchange with the machine is facilitated, at least in part, by extending air flow openings through the acoustic media and the machine housing.

DETAILED DESCRIPTION

Figure 1A:
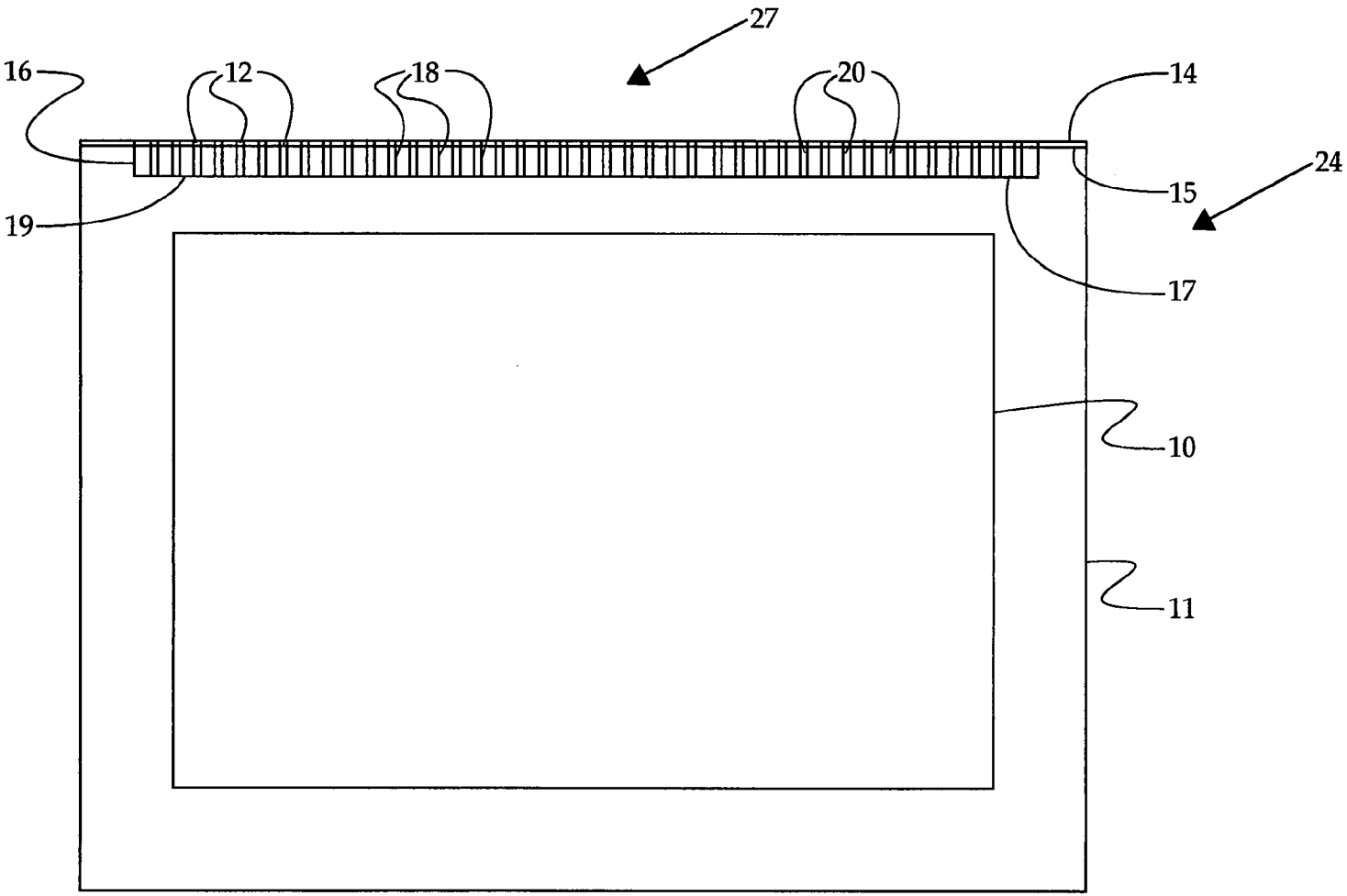
FIG. 1*a* is a schematic representation of an engine assembly, according to the present disclosure.

Referring to FIG. 1*a*, there is shown a schematic representation of an engine assembly 24, according to the present disclosure. The engine assembly 24 is an enclosed machine assembly 27 that includes a machine operable to produce noise, being an engine 10, at least partially surrounded by a machine housing, being an engine housing 11. Although the machine assembly 27 is preferably the engine assembly 24, the present invention contemplates the machine assembly including an enclosed machine operable to produce noise and requiring ventilation, including, but not limited to, fan enclosures, ventilated hydraulic system enclosures, industrial machinery, and residential heat pumps. In fact, the present disclosure contemplates use with machine assemblies other than the engine 10 within a work machine. It should further be appreciated that the engine 10 could be any type of internal combustion engine used in various applications. For instance, although the engine 10 is illustrated as an engine used within a work machine, such as a construction or mining machine, the present disclosure applies similarly to engines that are included within smaller vehicle and generator sets. The engine housing 11 includes at least a portion 14 that defines air flow openings 12. The portion 14 is comprised of a relatively non-sound absorbent material, such as sheet metal. The housing 11, including the portion 14, protects the engine 10 from damaging elements, such as rocks and debris during engine operation and pressurized water during cleaning. The portion 14 of the housing 11 defining the air flow openings 12 preferably includes a detachable housing panel 15 that can be removed to be serviced, although it should be appreciated that other portions of the housing 11 can also include air flow openings. The detachable panel 15 defines the air flow openings 12. Those skilled in the art will also appreciate that the engine housing can include more than one detachable panel at different positions surrounding the engine.

At least one acoustic media grille 16 is preferably positioned between the engine 10 and the engine housing 11. The acoustic media grille 16 is preferably attached to the panel 15 in any conventional manner, including but not limited to, the use of bolts and/or adhesives. The acoustic media grille 16 includes a relatively sound absorbent media 17 that, like the panel 15, defines air flow openings 18. Although the present disclosure contemplates the use of various relatively sound absorbent media 17, including, but not limited to, fiberglass, the relatively sound absorbent media is preferably an acoustic open-cell foam, such as a melamine or polyurethane foam. The acoustic media 17 is preferably coated with a coating 19 in order to protect the acoustic media 17 from water and other liquids in which the media 17 may come in contact during use. The protective coating 19 is generally a thin metallic or non-metallic film and is preferably an encapsulation film known in the art, such as a latex or polyurethane coating. The coating 19 may be applied to one or more surfaces of the acoustic media such as the front and back surfaces, but preferably is an encapsulation film applied to all surfaces of the acoustic media 17 including the media surfaces defining the air flow openings 18 in the acoustic media 17. The coating 19 significantly enhances the sound transmission loss of the acoustic media grille 16 in the mid-range frequencies from about 600 to 2000 Hz. It should be appreciated that engine and machine components produce a majority of noise within this frequency range, often including the most annoying noise associated with strong tones. The air flow openings 18 of the acoustic media grille 16, at least partially, correspond to the air flow openings 12 of the panel 15 to form an at least partially unobstructed air flow path 20. Preferably, the air flow path 20 is relatively unobstructed. The unobstructed flow path 20 facilitates air exchange with the engine 10 by allowing direct flow along a line without requiring movement around a serpentine path, or the like.

Figure 1B:
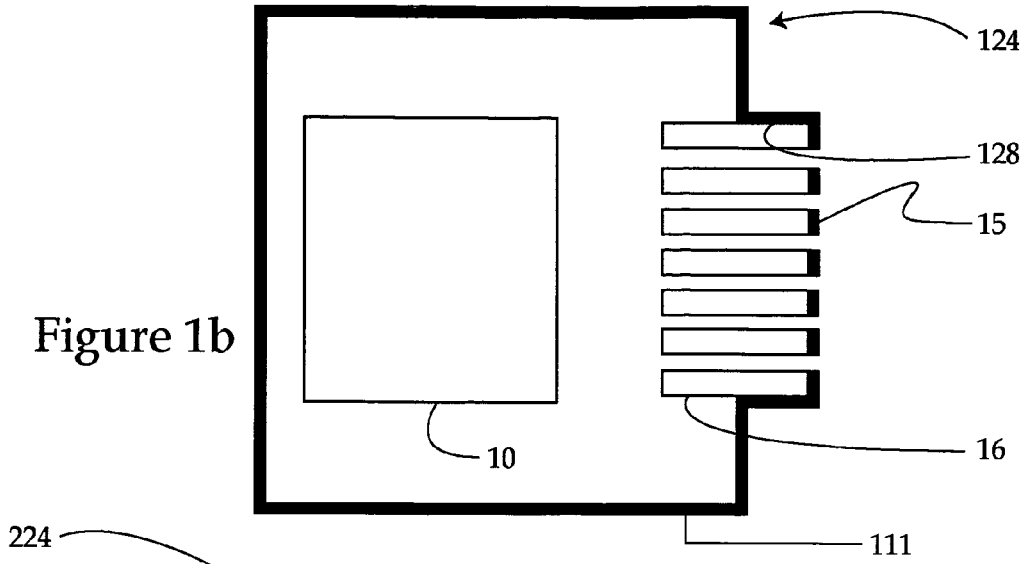
FIG. 1*b–d* are schematic representations of an engine assembly, according to alternate embodiments of the present disclosure.
Figure 1C:
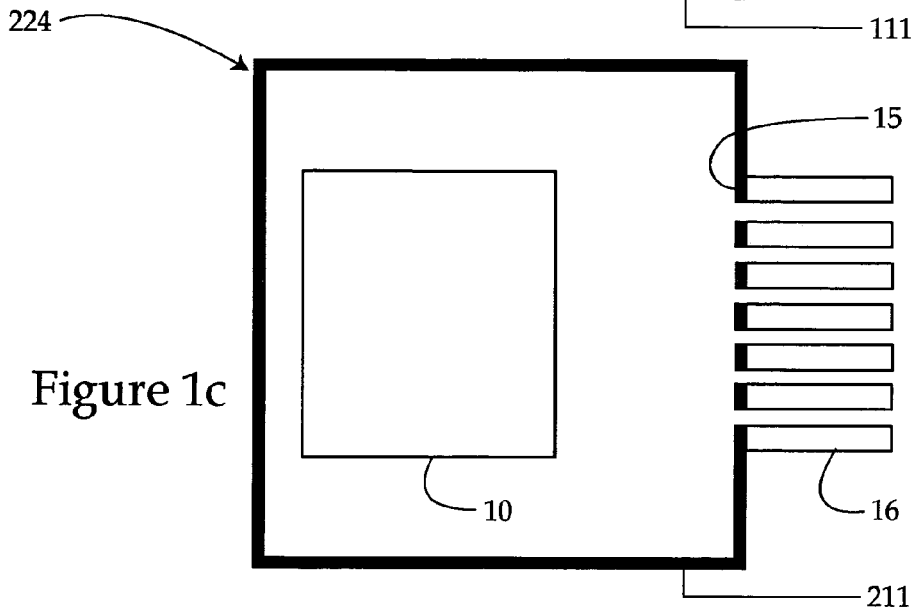
Figure 1D:
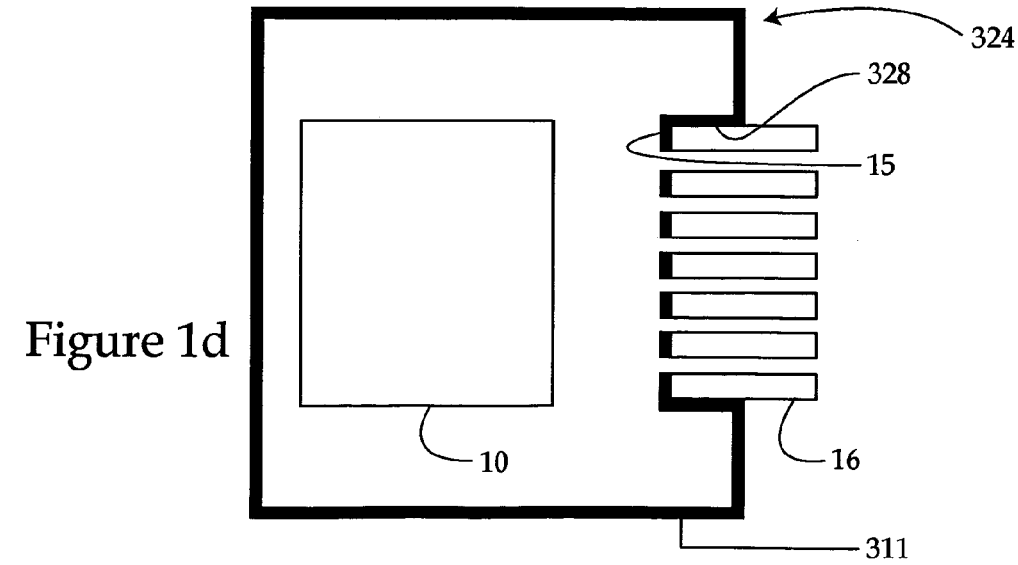

Referring to FIGS. 1*b–d*, there are shown schematic representations of engine assemblies 124, 224, 324 according to alternate embodiments of the present disclosure. Although the acoustic media grille 16 is preferably positioned between the engine 10 and the engine housing 11 as shown in FIG. 1*a*, the acoustic media grille 16 can be positioned at any location adjacent to the housing panel 15. According to FIG. 1*b*, an engine housing 111 defines an acoustic media grille bore 128 in which the acoustic media grille 16 is positioned. The engine housing 111 defining the bore 128 includes protrusions away from the engine 10. Thus, although the acoustic media grille is positioned between the panel 15 and the engine 10, a portion of the grille 16 extends beyond a portion of the engine housing 111. According to FIGS. 1*c* and 1*d*, the acoustic media grille 16 can be externally attached to the engine housing 211 and 311 such that the engine housing 211 and 311 is between at least a portion of the acoustic media grille 16 and the engine 10. As illustrated in FIG. 1*b*, the engine housing 311 can include an acoustic media grille bore 328 that extends inwardly toward the engine 10.

Figure 2B:
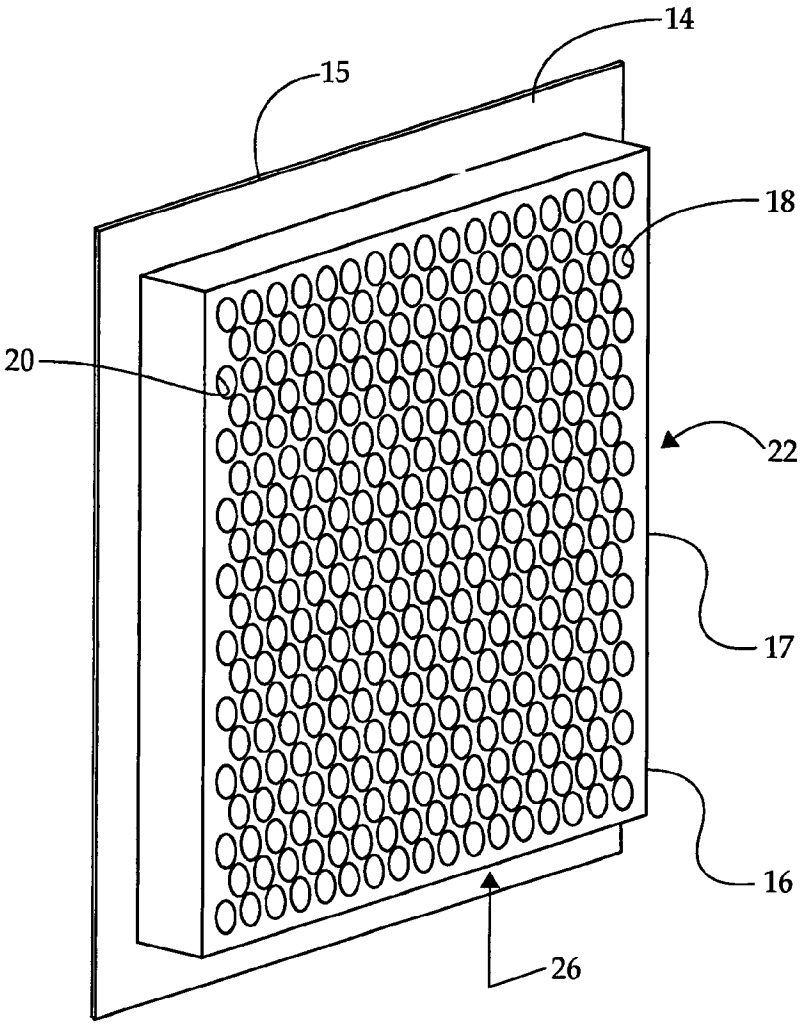
FIG. 2*b* is a perspective diagrammatic view of a back side of the acoustic media grille attached to the housing panel within the engine assembly of FIG. 1*a;*
Figure 2A:
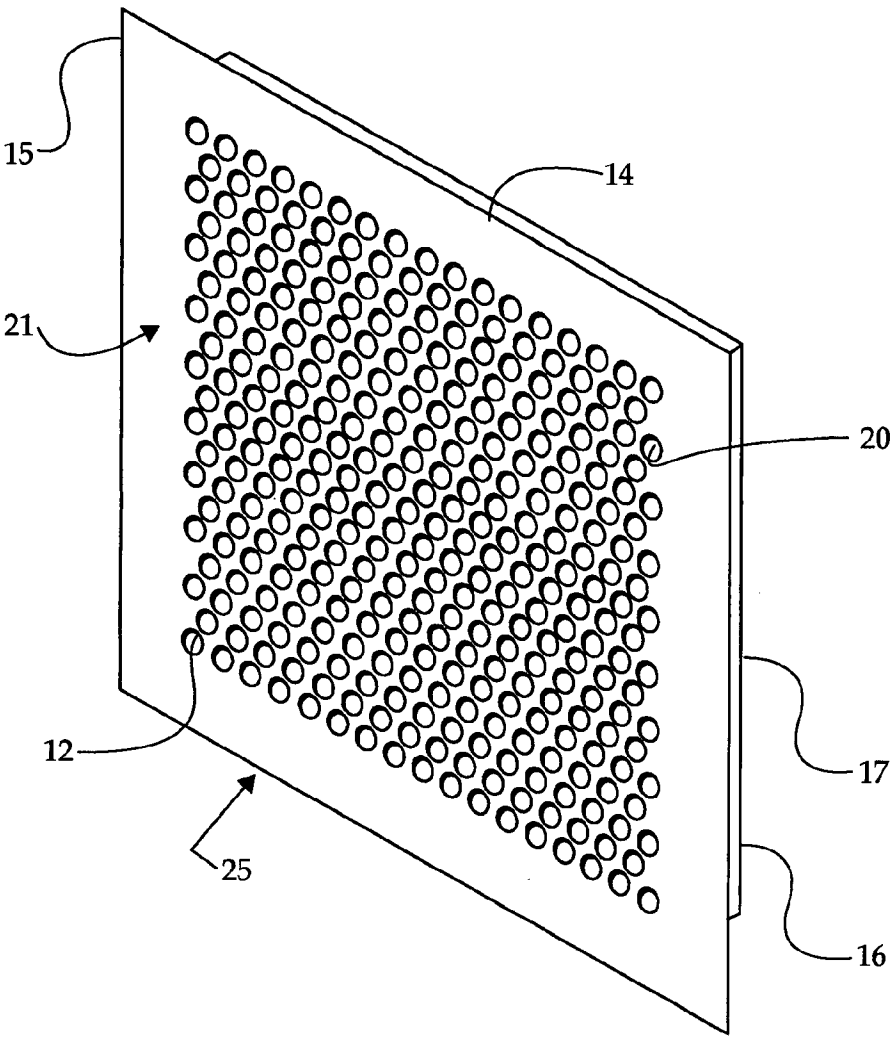
FIG. 2*a* is a perspective diagrammatic view of a front side of a housing panel and attached acoustic media grille within the engine assembly of FIG. 1*a;*

Referring to FIGS. 2*a* and 2*b*, there are shown perspective views of a front side 25 of the housing panel 15 and a back side 26 of the attached acoustic media grille 16 of FIG. 1*a*, respectively. Although the acoustic media grille 16 is illustrated as rectangular, it should be appreciated that the grille could be of various shapes. Because the media 17 is preferably the open-cell foam, it is flexible and compact, and thus, can be positioned within an irregular-shaped and/or limited space between the engine and the housing panel. Preferably, the air flow openings 18 of the acoustic material grille 16 include a pattern 22 identical to a pattern 21 of the air flow openings 12 of the detachable panel 15. However, the present disclosure contemplates only a portion of the air flow openings 12 and 18 including identical patterns. By aligning the acoustic media grille 16 with the panel 15, the air flow path 20 formed by the identical patterns 21 and 22 of air flow openings 12 and 18 is unobstructed. The unobstructed air flow path 20 allows air to be drawn to the engine 10, while the relatively sound absorbent acoustic media 17 absorbs the noise from the engine 10 and the panel 15 provides structural rigidity for the acoustic media grille 16 and protects the engine 10 from debris.

It should be appreciated that although in the illustrated example, the air flow openings 12 and 18 are uniform, circular, evenly spaced and arranged in multiple straight rows which are offset from one another, the matching patterns 21 and 22 can vary. For instance, the air flow openings 12 and 18 can be of various shapes, including, but not limited to, rectangular, and the air flow openings 12 and 18 need not be evenly spaced or offset from one another. Further, in order to assure that the flow of air to and from the engine 10 is not unduly restricted, the acoustic media 17 includes a predetermined openness percentage. The predetermined openness percentage is the combined area of the air flow openings 18 over the entire area, including the area of the air flow openings 18, of the acoustic media grille 16. The predetermined openness percentage is sufficiently large to ensure adequate air flow to the engine 10, and sufficiently small to provide sound absorption through the media 17 and material thickness between the openings 18 for structural support. It should be appreciated that small holes, such as holes including a diameter less than 10 mm, may become blocked with dirt and may be difficult to align with air flow openings 12. In the illustrated engine 10, openness percentages as large as 75% have been found to be acceptable. In order to achieve the predetermined openness percentage, the diameter or spacing of the air flow openings 18 can be altered. Although sound absorption is generally affected by the predetermined openness percentage, at higher frequencies, such as over 3000 Hz, the diameter of the air flow openings can also significantly affect sound absorption. Smaller diameter air flow openings may increase absorption of the higher frequency sound waves. Further, the spacing and diameter are often limited by a minimum material thickness that must separate the holes 18 for manufacturing and structural purposes.

Figure 3:
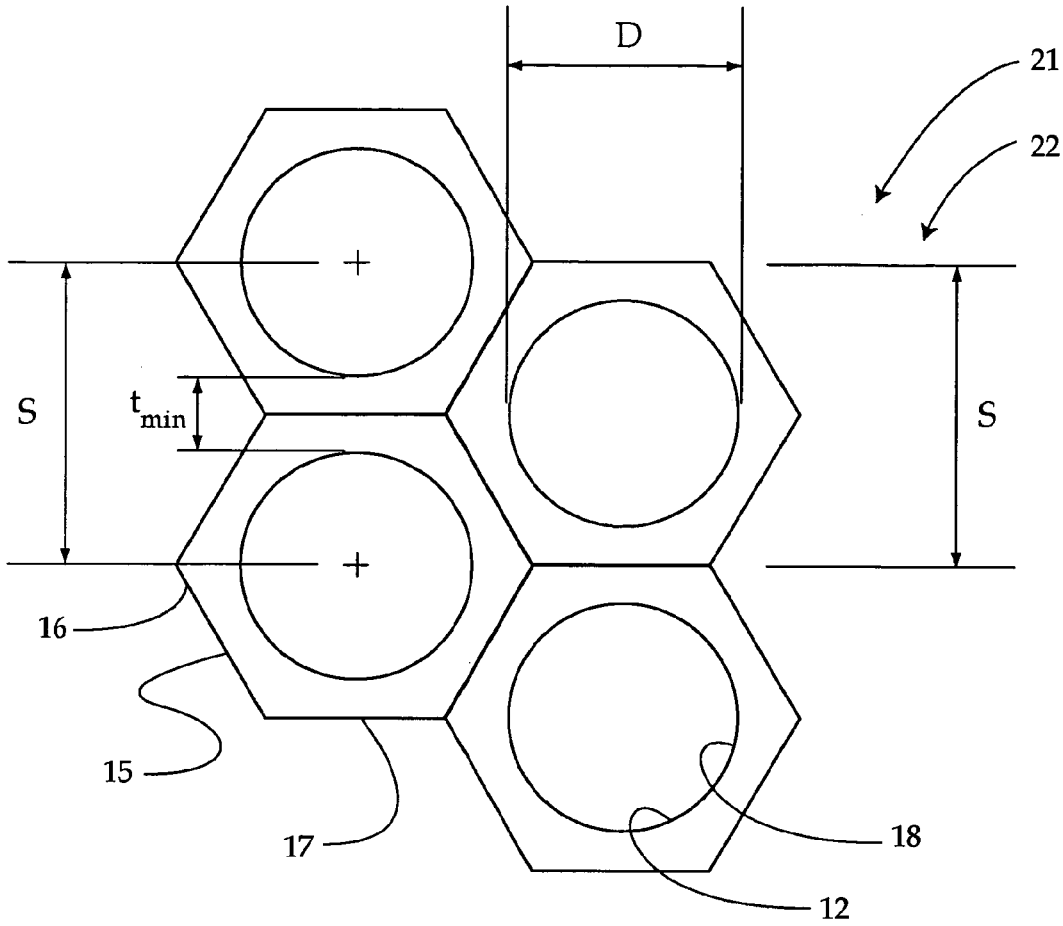
FIG. 3 is a diagrammatic representation of a pattern of air flow openings through the housing panel and the acoustic media grille of FIGS. 2*a* and 2*b;*

Referring to FIG. 3, there is shown a diagrammatic representation of the patterns 21 and 22 of the air flow openings 12 and 18 of the panel 15 and acoustic media grille 16 of FIGS. 2*a–b*, respectively. In the illustrated embodiment in which the air flow openings 12 and 18 includes patterns 21 and 22, a relationship between the opening diameter (D), the spacing (S) between air openings 12 or 18, a minimal material thickness (tmin) and the openness percentage (P) can be expressed in a formula set forth in FIG. 3. For manufacturing purposes and structural integrity, the thickness between the air openings 12 and 18 ordinarily should not be less than the minimal material thickness (tmin). Thus, the diameter of the openings 12 and 18 are somewhat limited by the material thickness (tmin). Further, the diameter of the openings 12 and 18 can be influenced by the desired amount of sound absorption. At higher frequencies, smaller diameter openings may be needed to reduce the noise from the engine 10.

Figure 4:
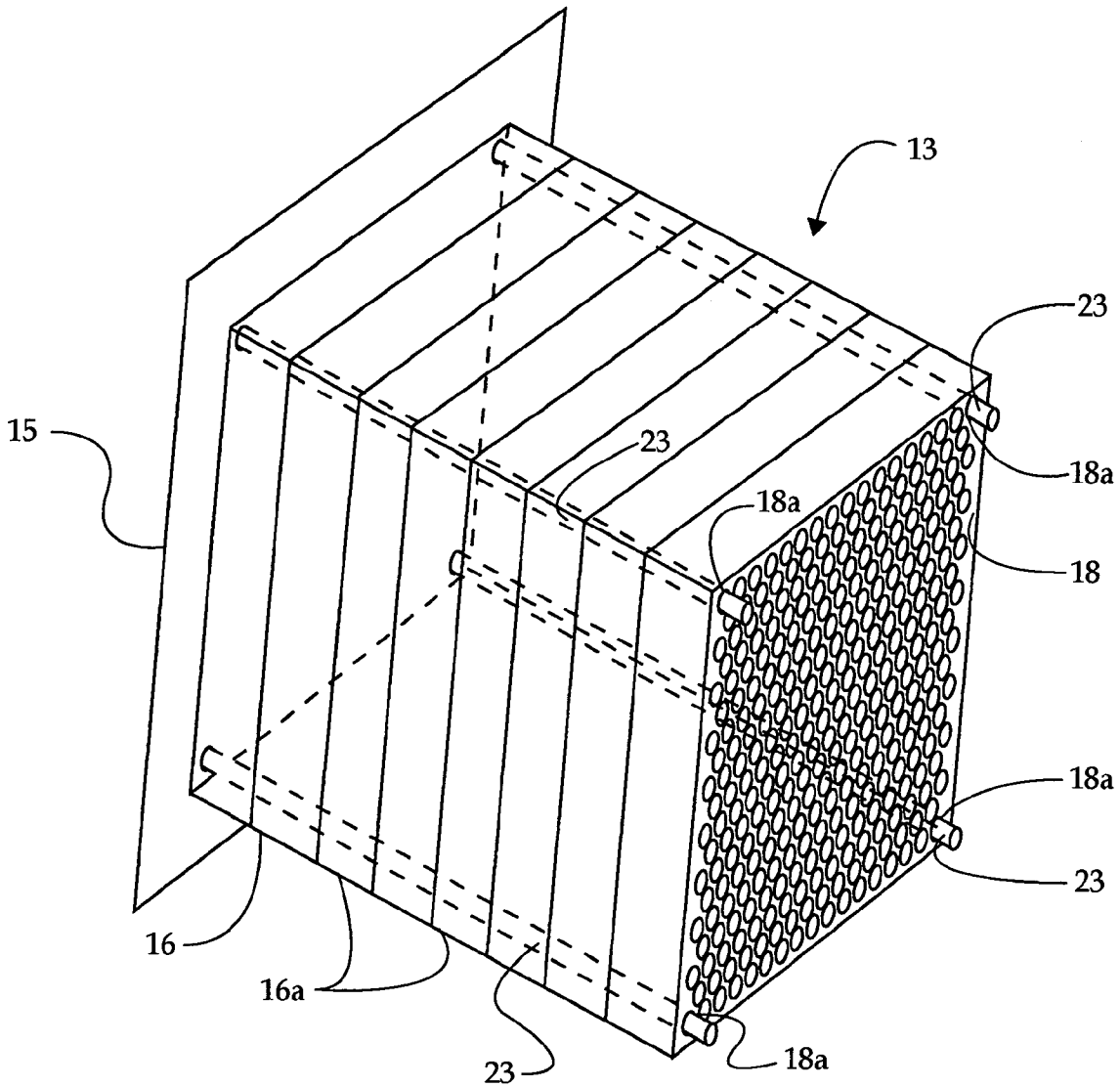
FIG. 4 is a perspective diagrammatic representation of a stack of acoustic media grilles attached to the housing panel, according to the present disclosure.

Referring to FIG. 4, there is shown a diagrammatic representation of a stack 13 of acoustic media grilles attached to the panel 15, according to the present disclosure. The stack 13 of acoustic media grilles is positioned between the engine 10 (shown in FIG. 1) and the detachable panel 15 and includes seven additional acoustic media grilles 16*a* identical to acoustic media grille 16. The acoustic media grille 16 is a first acoustic media grilles attached to the panel 15 in a conventional manner, such as with adhesives. Although the stack 13 is illustrated as including eight acoustic media grilles 16 and 16*a*, it should be appreciated that the present disclosure contemplates any number, including only one, acoustic media grille being positioned between the engine 10 and the panel 15. The acoustic media grilles 16 and 16*a* can vary in width depending on the size of the engine 10 and the desired noise reduction, but, in the illustrated example, each grille 16 or 16*a* is approximately one inch thick. It should be appreciated that the larger the engine and the more noise reduction desired, the greater the depth of acoustic media between the engine and the panel. It has been found that applying the protective coating 19 to each acoustic media grille 16 in the stack 13 greatly enhances the noise attenuation properties of the stack 13. Preferably, an encapsulation film is applied to each acoustic media grille 16, including the front and back surfaces, side surfaces, and surfaces defining the air flow openings 18 in the acoustic media 17. Each layer provides enhanced noise attenuation properties and synergistically combines to provide high noise attenuation of the stack 13. The density of the acoustic media 17 used can also vary. It has been found that increased density of the media 17 can increase sound absorption at relatively high frequencies, such as above 2000 Hz.

The stack 13 includes at least one alignment feature that is operable to maintain hole alignment in the stack 13. The present invention contemplates various types of alignment features, including but not limited to, adhesives. However, the acoustic media grilles 16*a* are preferably aligned with the first acoustic media grille 16 by at least one alignment member 23. In the illustrated example, there are four alignment members, being four identical rods 23, which are attached to the panel 15 by conventional means, such as welding. Each rod 23 is attached to the panel 15 such that the rod 23 can extend through a corner air flow opening 18*a* of each acoustic media grille 16. Thus, the rods 23 are sized to fit within the air flow openings 18*a*. It should be appreciated that the corner air flow openings 18*a* can be either the same or a different size than the other air flow openings 18. By extending the rods 23 through the corner air flow openings 18*a* of each acoustic media grille 16, the relatively alignment of the air flow openings 18 of each grille 16 can be assured.

Figure 5B:
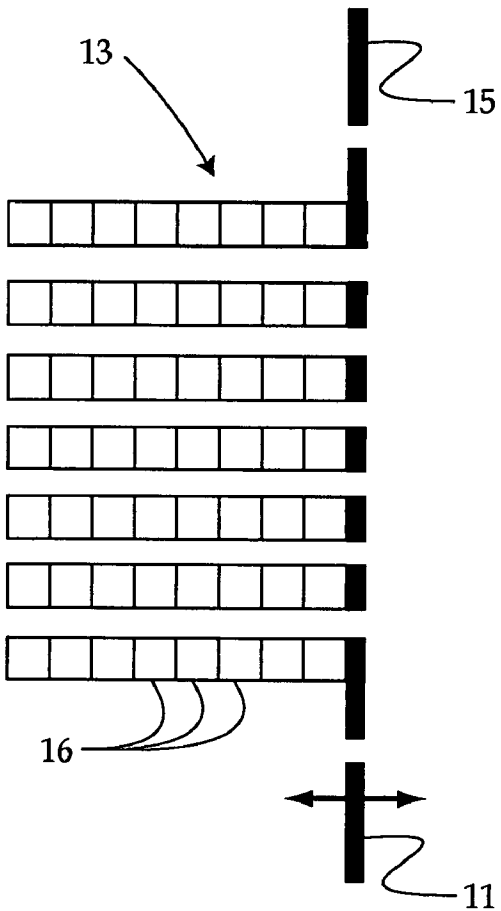
FIGS. 5*a* and 5*b* are schematic representations of the acoustic media grille stack attached to the panel of FIG. 4 in flexed positions.
Figure 5A:
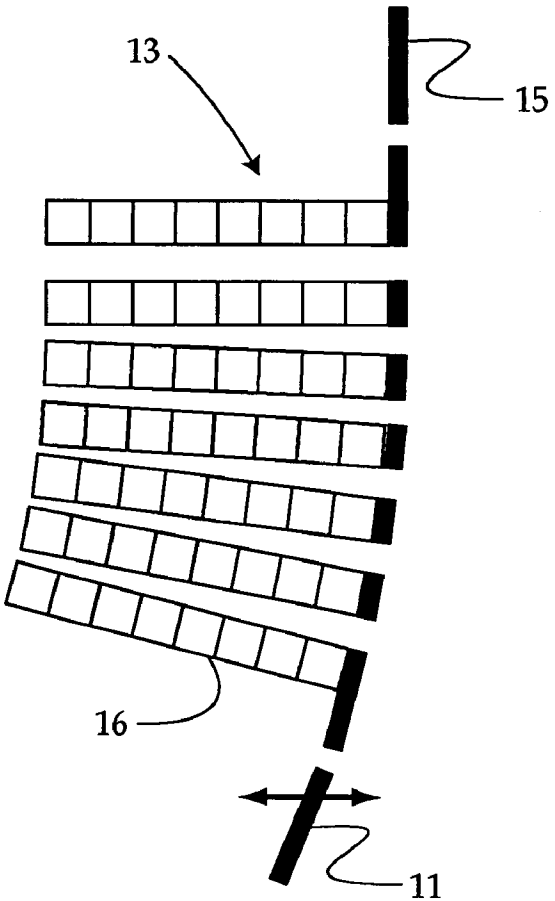

Referring to FIGS. 5*a* and 5*b*, there are shown schematic representations of the acoustic media grille 16 attached to the panel 15 in flexed positions. Preferably the panel 15 is flexible such that some relative motion between engine housing components can exist, as illustrated in FIG. 5*b*. Moreover, the flexibility of the panel 15 can allow the panel 15 to conform to the shape of the engine housing. Although a rigid panel can be designed to fit with irregular shaped engine housings, the flexible panel 15 can fit with engine housing surfaces with widely varying tolerances.

INDUSTRIAL APPLICABILITY

Referring to FIGS. 1–5*b*, a method of attenuating engine noise will be discussed for the engine 10. It should be appreciated that the method for alternating engine noise is similar to the method for attenuating noise from any machine enclosed by a housing with perforations. It should also be appreciated that the method of attenuating engine noise will be similar for engines with different intended applications and producing different frequency sounds. In order to protect the engine 10 for debris and dirt, the engine 10 is surrounded by the engine housing 11. The detachable panel 15 of the engine housing 11 includes air flow openings 12 to allow air flow to the engine 10.

The acoustic media 17, preferably an open-cell foam, is positioned between the detachable panel 15 of the engine housing 11 and the engine 10. The acoustic media grille 16 can be shaped and sized to fit within the space between the engine 10 and the panel 15. Due to the flexibility of the panel 15 and/or the acoustic media 17, the acoustic media grille 16 can fit within an irregular-shaped and/or relatively small space between the engine and the panel. In order to attach the acoustic media grille 16 to the panel 15, each alignment rod 23 attached to the panel 15 is extended through one of the corner air flow openings 18*a*. The first acoustic media grille 16*a* can be secured to the panel in a conventional manner, such as with adhesives. The rods 23 are extended through the corner air flow openings 18*a* of the additional acoustic media grilles 16*a*, thereby aligning the air flow openings 18 of the additional acoustic media grilles 16*a* with the air flow openings 18 of the first acoustic media grille 16. It should be appreciated that the position of the additional acoustic media grilles 16*a* could be secured by various conventional means, including but not limited to, threading a nut to a threaded end portion of the rods. The rods 23 eliminate the need for a space consuming retaining structure.

Depending on the size of the engine and the desired amount of noise reduction, any number of acoustic media grilles can be included within the stack. As the engine 10 operates and creates noise, the sound waves are absorbed by the acoustic media 17 and preferably dampened by the coating 19 as the sound passes through the grilles 16 and 16*a* and panel 15. Thus, as the sound passes from the engine 10, the engine noise will be attenuated. Depending on the frequency of the sound created by the engine, the density and the diameter of the air flow openings 18 may be altered. It has been found that increasing the density of acoustic media 17 and/or decreasing the diameter of the air flow openings 18 can increase the absorption of sound at higher frequencies, such as 2000 Hz and greater. Moreover, it has been found that at the higher frequencies, such as 1500 Hz and greater, the protective coating may dampen the sound as well as it does at lower frequencies.

In order to facilitate air exchange with the engine 10, the air flow openings 18 and 12 are extended through the acoustic media 17 and the panel 15, respectively. In other words, the air flow openings 12 and 18 are aligned in order to reduce any flow restriction caused by the acoustic media grille 16 and the panel 15. The more alignment between the air flow openings 12 and 18, the less obstructed the path 17. In fact, the air flow to the engine 10 is preferably facilitated by matching the pattern 22 of the air flow openings 18 through the acoustic media 16 to the pattern 21 of the air flow openings 12 through the panel 15. Thus, the acoustic media 16 will be manufactured to include the same staggered pattern 22 as the air flow openings 12 of the panel 15.

Preferably, the pattern 22 of the air flow openings 18 through the acoustic media 16 will be adjusted to obtain the predetermined openness percentage (P) of the acoustic media 17. The predetermined openness percentage (P) is the amount of openness that can provide adequate air flow to the engine 10 while also allowing sufficient noise attenuation and providing protection from the elements through the panel 15. The predetermined openness percentage (P) may be determined experimentally and differ between engines. The predetermined openness percentage (P) can be achieved by altering the diameter (D) of or spacing (S) between the air flow openings 18. However, due to structural and manufacturing limitations, there should be a minimum amount of thickness (tmin) between the holes 18. The formula illustrating the relationship between the spacing (S), diameter (D), openness percentage (P) and the minimum thickness (tmin) set forth in FIG. 3 can be used to determine the dimensions of pattern 22, and thus, pattern 21. Preferably, at lower frequencies, the diameter (D) should be as large as possible without compromising the structural integrity of the panel 15 and media grille 16. At higher frequencies, the hole diameter (D) is preferably smaller in order to increase sound absorption. Thus, without decreasing the spacing (S) below the minimum thickness (tmin), the spacing (S) can be adjusted in order to achieve the desired diameter (D) and openness percentage (P).

Although the pattern 22 of the acoustic media 17 is adjusted to achieve the predetermined openness percentage (P), preferably the pattern 22 still matches the pattern 21 of the air flow openings 12 defined by the panel 15. Thus, it should be appreciated that a detachable panel could include air flow openings that are sufficiently sized and spaced such that the acoustic media grille can be retrofitted to match the existing pattern of the air flow openings of the detachable panel. Thus, the holes through the media grille may have an identical pattern to that of the housing, but each hole is larger than that through the engine housing. In addition, if the air flow openings of a pre-existing panel were not sufficiently sized such that the matching pattern would provide the predetermined openness percentage of the acoustic media, a new panel could be manufactured relatively inexpensively with newly sized and spaced air flow openings.

The present disclosure is advantageous because the engine housing, including the panel 15, can protect the engine 10 from damaging elements and the acoustic media grille 16 can reduce engine noise while still allowing air flow to the engine 10 through the unobstructed air flow path 20. Because the flow path 20 is preferably unobstructed, the restriction on the air flow to and from the engine 10 is tolerable. By adjusting the pattern 22 of the air flow openings 18 in the acoustic media 17 to include the predetermined openness percentage (P), adequate air exchange with the engine 10 is achieved. As sound waves from the engine 10 pass through the air openings 18 and the acoustic media 17, the acoustic media 17 can absorb the sound, and, in engines, such as engine 10, in which the sound waves are at a relatively low frequency, the coating 19 can dampen the sound waves. In addition, depending on the frequency of the sound from the engine, the pattern of the air flow openings through the acoustic media can be adjusted to increase the sound absorption. Moreover, the panel 15, being made from sheet metal, can not only protect the engine 10 from debris, sand, rocks, but also provide structural rigidity for the acoustic media 17.

The present disclosure is further advantageous because the acoustic media grille 16 is relatively inexpensive and simple to manufacture. For instance, the acoustic media grille 16 can be manufactured by various conventional means, such as molded or die-cut, and the coating 19 can be applied in a conventional manner, such as sprayed. Further, the flexibility and compactness of the acoustic media 17, such as the open-cell foam, allows the acoustic media grille 16 to fit within relatively small and/or irregular-shaped space. The acoustic media grille 16 can be retrofitted on existing engines relatively inexpensively and with little, or no, modification to the housing. By mounting the media grilles 16 and **16*a* on the aligning rods 23, there is no need for an expensive retaining system. Moreover, because the pattern of the openings, density of the media and number of grilles 16 can be altered to address the needs of different engines, the present disclosure can find application with any engine surrounded by an engine housing. It should be appreciated that the acoustic media grille could also find application in any enclosed machine producing noise and requiring ventilation, including, but not limited to, fan enclosures, ventilated hydraulic system enclosures, industrial machinery, and residential heat pumps. Many of these machines, such as the fan enclosures and ventilated hydraulic system enclosures, can be found within a work machine like the engine 10**.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. An at least partially enclosed machine assembly comprising:

a machine operable to produce noise;

a machine housing of a relatively non-sound absorbent material at least partially surrounding the machine and including at least one portion defining air flow openings;

at least one acoustic media grille of a relatively sound absorbent material being attached to the at least one portion of the machine housing defining air flow openings; and the air flow openings of the acoustic media grille, at least partially, corresponding to the air flow openings of the portion of the machine housing to form an at least partially unobstructed air flow path.

2. The machine assembly of claim 1 wherein the machine being an engine, and the machine housing being an engine housing; and the at least one acoustic media grille being positioned between the engine and the at least one portion of the engine housing.

3. The machine assembly of claim 2 wherein the acoustic media grille includes acoustic media including an open-cell foam.

4. The machine assembly of claim 2 wherein at least a portion of the acoustic media grille includes a coating.

5. The machine assembly of claim 2 wherein the air flow openings of acoustic material grille include a pattern identical to a pattern of the air flow openings of the portion of the engine housing.

6. The machine assembly of claim 2 wherein the acoustic media grille includes a predetermined openness percentage.

7. The machine assembly of claim 2 wherein the portion of the engine housing includes a detachable panel.

8. An at least partially enclosed machine assembly comprising:

an machine operable to produce noise;

an machine housing, at least, partially surrounding the machine and including at least one portion defining air flow openings:

at least one acoustic media grille being positioned adjacent to the at least one portion of the machine housing, and defining air flow openings;

the air flow openings of the acoustic media grille, at least partially, corresponding to the air flow openings of the portion of the machine housing to form an at least partially unobstructed air flow path;

wherein the machine being an engine, and the machine housing being an engine housing;

the at least one acoustic media grille being positioned between the engine and the at least one portion of the engine housing;

wherein the at least one acoustic media grille being a first acoustic media grille in a stack of acoustic media grilles; and at least one acoustic media grille includes a coating on at least one of a front surface and a back surface of the acoustic media grille.

9. The machine assembly of claim 8 wherein each acoustic media grille includes a coating attached to the front surface, the back surface, and surfaces defining the air flow openings of each acoustic media grille.

10. An at least partially enclosed machine assembly comprising:

an machine operable to produce noise;

an machine housing, at least, partially surrounding the machine and including at least one portion defining air flow openings;

at least one acoustic media grille being positioned adjacent to the at least one portion of the machine housing, and defining air flow openings;

the air flow openings of the acoustic media grille, at least partially, corresponding to the air flow openings of the portion of the machine housing to form an at least partially unobstructed air flow path;

wherein the machine being an engine, and the machine housing being an engine housing;

the at least one acoustic media grille being positioned between the engine and the at least one portion of the engine housing;

wherein the at least one acoustic media grille being a first acoustic media grille in a stack of acoustic media grilles; and the stack includes at least one alignment feature operable to maintain hole alignment in the stack.

11. The machine assembly of claim 10 wherein each acoustic media grille includes a predetermined openness percentage, a coating attached to at least a portion of surfaces of the acoustic media grille, and an acoustic media including an open-cell foam;

the air flow openings of each acoustic material grille include a pattern identical to a pattern of the air flow openings of the portion of the engine housing; and the portion of the engine housing includes a detachable panel.

12. A machine housing component comprising:

a panel being comprised of a relatively non-sound absorbent material and defining air flow openings;

an acoustic media grille being attached to the panel and including an acoustic media being relatively sound absorbent material and defining air flow openings; and the air flow openings of the acoustic media, at least partially, corresponding to the air flow openings of the panel to form an at least partially unobstructed air flow path.

13. The machine housing of claim 12 wherein the panel being a detachable portion of an engine housing.

14. The machine housing component of claim 12 wherein the relatively sound absorbent media includes an open-cell foam.

15. The machine housing component of claim 12 wherein at least a portion of the acoustic media grille includes a coating.

16. The machine housing component of claim 15 wherein the coating includes an encapsulation film.

17. The machine housing component of claim 12 wherein the air flow openings of acoustic material grille include a pattern identical to a pattern of the air flow openings of the portion of the engine housing.

18. The machine component of claim 12 wherein the acoustic media includes a predetermined openness percentage.

19. A machine housing component comprising:

a panel being comprised of a relatively non-sound absorbent material and defining air flow openings;

an acoustic media grille being attached to the panel and including an acoustic media being relatively sound absorbent and defining air flow openings;

the air flow openings of the acoustic media, at least partially, corresponding to the air flow openings of the panel to form an at least partially unobstructed air flow path;

wherein the at least one acoustic media grille being a first acoustic media grille in a stack of acoustic media grilles; and the stack includes at least one alignment feature operable to maintain hole alignment in the stack.

20. The machine component of claim 19 wherein the panel being a detachable portion of an engine housing;

the relatively sound absorbent media includes an open-cell foam and a predetermined openness percentage;

at least a portion of each acoustic media grille includes a coating; and the air flow openings of each acoustic media include a pattern identical to a pattern of the air flow openings of the portion of the engine housing.

21. A method of attenuating engine noise, comprising the steps of:

at least partially surrounding an engine with an engine housing of a relatively non-sound absorbent material;

attaching an acoustic media of a relatively sound absorbent material to the engine housing; and facilitating air exchange with the engine, at least in part, by extending air flow openings through the acoustic media and the engine housing and the attachment therebetween.

22. The method of claim 21 wherein the step of facilitating includes a step of matching a pattern of air flow openings through the acoustic media to a pattern of air flow openings through the engine housing.

23. The method of claim 21 wherein the step of facilitating includes a step of adjusting a pattern of air flow openings through the acoustic media to obtain a predetermined openness percentage of the acoustic media.

* * * * *